United States Patent [19]

Lapolice

[11] 3,930,652

[45] Jan. 6, 1976

[54] PORTABLE LAWN PLAYING CHECKER APPARATUS

[75] Inventor: Leo Lapolice, Trois Rivieres, Canada

[73] Assignee: Lawrence Peska Associates, Inc., New York, N.Y. ; a part interest

[22] Filed: Sept. 12, 1974

[21] Appl. No.: 505,345

[52] U.S. Cl...... 273/136 K; 273/137 R; 273/148 R; 273/136 D; 273/136 G

[51] Int. Cl.[2]..... A63F 3/02

[58] Field of Search..... 273/131, 136, 137

[56] References Cited

UNITED STATES PATENTS

| | | | |
|---|---|---|---|
| 16,116 | 11/1856 | Goodwin | 273/136 K UX |
| 621,799 | 3/1899 | Degges | 273/131 B |
| 877,814 | 1/1908 | Wallstein | 273/136 A |
| 1,254,380 | 1/1918 | Whitmore | 273/137 R UX |
| 1,430,778 | 10/1922 | Williams | 273/136 K UX |
| 1,623,881 | 4/1927 | Mayer | 273/131 KN |
| 2,548,606 | 4/1951 | Huffaker | 273/136 K |
| 2,946,592 | 7/1960 | Post | 273/136 K X |

*Primary Examiner*—Delbert B. Lowe

[57] ABSTRACT

A portable lawn playing checker apparatus comprised of:

a rectangular base board having a first and a second face; with a plurality of rectangles inscribed upon the first face and a first storage compartment and a second storage compartment attached to the second face of the rectangular base board on opposite ends of the base board for storing a plurality of movable rings, which are used as checkers. The base board is further comprised of first and second holding compartments on said first face for holding the movable rings during the game. The base board has a hinge between the first storage compartment and the second storage compartment for folding the rectangular base board in half. The portable lawn playing checker apparatus has a device for moving the movable rings from rectangle to rectangle.

8 Claims, 6 Drawing Figures

PORTABLE LAWN PLAYING CHECKER APPARATUS

This invention relates generally to games and more particularly to a game apparatus.

A primary object of the present invention is to provide a novel game apparatus for playing the game of checkers, chess, etc.

Another primary object of the present invention, in addition to the foregoing, is a game apparatus providing amusement, which can be played on the lawn, basement floor, etc., either indoors or outdoors.

Another and yet still further primary object of the present invention, in addition to each of the foregoing objects, is the providing of a novel game which is economical to produce and durable in use.

With the above related objects in view, this invention consists in the details of construction and combination of parts, as will be more fully understood from the following description, when read in conjunction with the accompanying drawings, in which.

Figure 1:
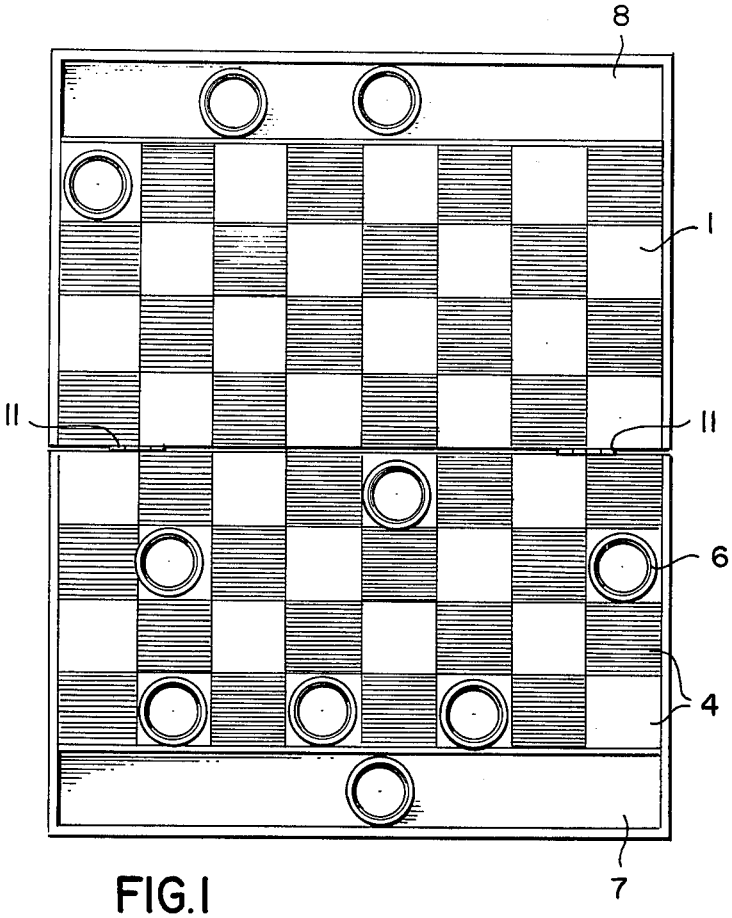
FIG. 1 is a top plan view of the portable lawn playing checker apparatus.
Figure 2:
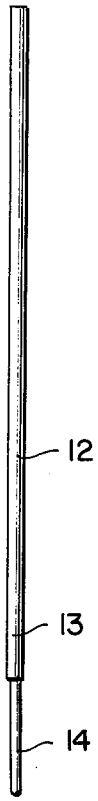
FIG. 2 is a side view of the means for moving the movable rings from rectangle to rectangle.
Figure 3:
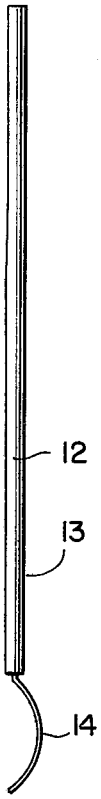
FIG. 3 is a front view of the means for moving the movable rings from rectangle to rectangle.
Figure 4:
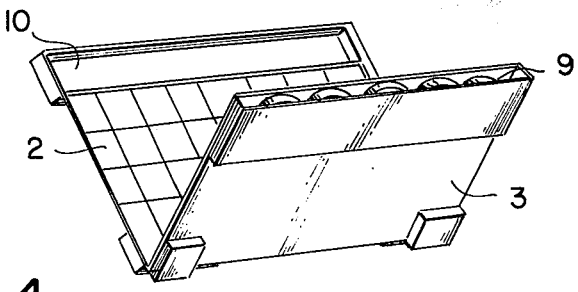
FIG. 4 is a perspective view of the portable lawn playing checker apparatus.
Figure 5:
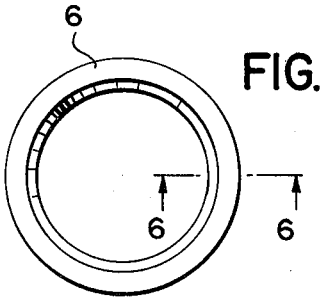
FIG. 5 is a plan view of one movable ring.
Figure 6:
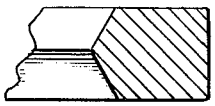
FIG. 6 is a sectional view taken along line 6—6 of FIG. 5.

The portable lawn playing checker apparatus, of this invention, is comprised of a base board 1 having a first face 2 and a second face 3.

A plurality of rectangles 4 are inscribed upon the first face of the base board. These rectangles may be alternately colored with different colors, for example, red and black, blue and green, etc.

The portable lawn playing checker apparatus of this invention is further comprised of a plurality of movable rings 6 which can fit within the rectangles 4. The movable rings are moved from rectangle to rectangle in playing the game in which this portable lawn playing checker apparatus is used.

The portable lawn playing checker apparatus is further comprised of a first holding means 7 and a second holding means 8 attached to the first face of the rectangular base board on opposite ends of the base board. The first holding means and the second holding means are used for holding the movable rings 6 when playing the game to be played on this portable lawn playing checker apparatus.

The checker apparatus is further comprised of a first storage means 9 and a second storage means 10 attached to the second face 3 of the rectangular base board, on opposite ends of the base board for storing the plurality of movable rings when not in use.

The checker apparatus is further comprised of a folding or hinge means 11 between the first storage means 9 and the second storage means 10. The folding means is used for folding the rectangular base board 1 in half for storage.

The checker apparatus is further comprised of a means 12 for moving the movable rings from rectangle to rectangle. An example of the means for moving the movable rings is a device having a reaching member 13 and a hook 14 on one end of the reaching member.

The plurality of rectangles may be comprised of a grid of eight rectangles by eight rectangles, usually found in the game of checkers or chess.

The plurality of movable rings can be of two colors, for example, red and black, blue and green, etc., wherein there are 16 movable rings.

The storage means and the holding means may be a shelf of sufficient size to store 16 movable rings.

The folding means generally consists of a plurality of hinges, although this invention contemplates the use of any type folding means.

The portable lawn playing checker apparatus of this invention can usually be used in playing the game of checkers or any variations of this game. The portable lawn playing checker apparatus may also be used in the game of chess, or any variations thereof, with slight modification of the movable rings.

The portable lawn playing checker apparatus may be placed on the lawn, or in a basement, and is usually of such a size so that the pieces may be easily seen from a long distance. For example, the base board may be about 4′2″ × 5′5″ and the 64 squares, for example, may be about 6 inches each. This invention, however, contemplates the use of any size portable lawn playing checker apparatus.

The portable lawn playing checker apparatus is designed so that it may be easily stored when not in use, by placing the movable rings within the first storage means and the second storage means and folding the base board in half.

The movable rings may be moved from rectangle to rectangle by means of a long reaching member having a hook on one end. This invention, however, contemplates the use of any type reaching member or means for moving the rings from rectangle to rectangle.

It is to be expressly understood that the embodiments or modifications of the invention heretofore described, disclosed, illustrated and shown are to be construed and interpreted as being illustrative only and for the sole purpose of aiding in the understanding of the present invention, and that this invention is not to be deemed limited thereby, but rather many variations may be made from the embodiments or modifications herein above described, disclosed, illustrated and shown.

For example, the movable rings may be provided with identifying indicia, other than colors, such as, and without limitation, letters, symbols, pictorial matter, groups of symbols, pictures, or the like, such as dots, bars or the like.

Different games may be thought up using the portable lawn playing checker apparatus.

While the invention has been described, disclosed, illustrated and shown in terms of certain preferred embodiments or modifications which it has assumed in practice, the scope of this invention should not be deemed to be limited by the precise embodiments or modifications herein described, disclosed, illustrated and shown. Such other embodiments or modifications as may be suggested to those having the benefit of the teachings herein are intended to be reserved, especially as they fall within the scope and breadth of the claims hereto appended.

Having thus described the invention, what is claimed as new is:

1. A portable lawn playing checker apparatus comprised of:

a. a rectangular base board having a first face and a second face whose length is about 5 feet 5 inches and whose width is about 4 feet 2 inches;

b. a plurality of rectangles inscribed upon the first face;

c. a plurality of movable rings which can fit within the rectangles;

d. a first holding means and a second holding means attached to the first face of the rectangular base board on opposite ends of the base board for holding the plurality of movable rings when a game is being played;

e. a first storage means and a second storage means attached to the second face of the rectangular base board on opposite ends of the base board and juxtaposed below the first holding means and the second holding means, for storing the plurality of movable rings when the portable lawn playing checker apparatus is being stored;

f. a foldong means between the first storage means and the second storage means for folding the rectangular baseboard in half for storage and g. a means for moving the movable rings from rectangle to rectangle.

2. The portable lawn playing checker apparatus of claim 1, wherein the plurality of rectangles are alternately colored with two colors.

3. The portable lawn playing checker apparatus of claim 1, wherein the plurality of rectangles are comprised of a grid eight rectangles by eight rectangles.

4. The portable lawn playing checker apparatus of claim 1, wherein the plurality of movable rings are of two colors.

5. The portable lawn playing checker apparatus of claim 1, wherein there are 16 movable rings.

6. The portable lawn playing checker apparatus of claim 1, wherein the storage means and the holding means are shelves of sufficient size to store 16 movable rings.

7. The portable lawn playing checker apparatus of claim 1, wherein the folding means is a plurality of hinges.

8. The portable lawn playing checker apparatus of claim 1, wherein the means for moving the movable ring is comprised of:

a reaching member; and a hook on one end of the reaching member.

* * * * *